United States Patent [19]

Takenaka et al.

[11] 4,197,487

[45] Apr. 8, 1980

[54] BEAM-INDEX TUBE APPARATUS HAVING DEFLECTION FIELD CORRECTING ELEMENTS

[75] Inventors: Shigeo Takenaka, Fukaya; Eizaburo Hamano, Kumagaya; Tetsuo Komatsu, Fukaya, all of Japan

[73] Assignee: Tokyo Shibaura Denki Kabushiki Kaisha, Kawasaki, Japan

[21] Appl. No.: 912,735

[22] Filed: Jun. 5, 1978

[30] Foreign Application Priority Data

Jun. 8, 1977 [JP] Japan ..... 52-66746

[51] Int. Cl.[2] ..... H01J 29/56

[52] U.S. Cl. ..... 315/370; 315/12 ND; 335/212

[58] Field of Search ..... 315/370, 368, 12 ND; 335/212

[56] References Cited

U.S. PATENT DOCUMENTS 3,371,206 2/1968 Takizawa ..... 315/370 X

FOREIGN PATENT DOCUMENTS 2621711 11/1977 Fed. Rep. of Germany ..... 335/212

*Primary Examiner*—Theodore M. Blum

*Attorney, Agent, or Firm*—Oblon, Fisher, Spivak, McClelland & Maier

[57] ABSTRACT

A beam-index tube apparatus comprising a beam-index picture tube provided with an electron gun to generate an electron beam of an oval cross-section, a deflecting device having a deflecting yoke for deflecting the electron beam, and correcting elements provided in the proximity of a front end of the deflecting yoke and positioned corresponding to the horizontal axis and the diagonal axes of the picture tube. The correcting elements act upon the electron beam in a manner such that the rotating of the diagonally deflected electron beam and widening of the horizontally deflected electron beam are thereby corrected.

3 Claims, 6 Drawing Figures

BEAM-INDEX TUBE APPARATUS HAVING DEFLECTION FIELD CORRECTING ELEMENTS

BACKGROUND OF THE INVENTION

1. Field of the Invention

This invention relates to a beam-index type color television picture tube, and more particularly to an electron beam deflecting device for the picture tube which can eliminate the widening and twisting distortion of the electron beam having an oval cross-section.

2. Description of the Prior Art

A beam-index type color picture tube apparatus of a conventional construction comprises a beam-index picture tube, which includes a phosphor screen provided on the inner surface of the faceplate and a neck portion containing an electron gun generating an electron beam of an oval cross-section, and a deflecting yoke provided outside of the neck portion of the picture tube for deflecting the electron beam.

The phosphor screen comprises red, green, and blue phosphor stripes, light absorbing stripes each disposed between the phosphor stripes. Indexing stripes are provided with interposition of an aluminum layer on the side of the phosphor stripes facing the electron gun in a predetermined relation with the phosphor stripes.

In order to obtain a high-quality image by the beam-index type tube apparatus of the conventional construction, the electron beam should have a cross-section of a predetermined dimension throughout the entire image of the picture tube. However, because of aberrations in the deflecting field the dimension i.e. size and shape of the electron beam is enlarged in the peripheral part of the image surface, with the electron beam rotated in the diagonal end part, thus making it impossible to obtain a high-quality image.

More specifically, in FIG. 4 showing one quarter of the display image X and Y represent a horizontal axis and a vertical axis of the beam-index type picture tube. As will be apparent from FIG. 4, at the central part of the display image, the electron beam has an oval cross-section of a predetermined size. However, at the end part of the horizontal axis X, the width in cross-section of the electron beam is widened, the beam straddling the three color stripes, while at the end part of the vertical axis Y, the length of the cross-section of the electron beam is increased, thus overlapping the adjacent scanning lines. At the ends of the diagonal line of the image the electron beam is rotated or inclined.

In order to prevent the electron beam from being expanded or rotated as described above, a dynamic focus correction has been imparted by applying voltages to the electron gun in synchronism with the horizontal and vertical deflections. However, these voltages amount to several hundred volts, and considering the fact that the static focusing voltage is of the order of several kilovolts, the circuits for supplying the voltages become too much complicated and costly. Particularly the circuit for the dynamic focus correction of the horizontal scanning of a high frequency is much more costly in comparison with the circuit for the dynamic focus correction for the vertical scanning. So, mere elimination of the former circuit would contribute much in the industry related thereto.

SUMMARY OF THE INVENTION

A primary object of the present invention is to provide a beam-index tube apparatus which can present a high-quality image.

Another object of the invention is to provide a beam-index tube apparatus wherein the widening and rotating of the electron beam due to the aberration in the magnetic field produced by the deflecting yoke can be substantially eliminated.

According to the present invention, the beam-index tube apparatus comprises a beam-index picture tube provided with an electron gun to generate an electron beam of an oval cross-section, and a deflecting device having a deflecting yoke for deflecting the electron beam, and correcting elements provided in the proximity of a front end of the deflecting yoke and positioned corresponding to the horizontal axis and diagonal axes of the picture tube, the correcting elements acting upon the electron beam, so that the widening of the horizontally deflected electron beam and the rotating of the diagonally deflected electron beam are thereby corrected.

DESCRIPTION OF THE PREFERRED EMBODIMENT

Figure 1:
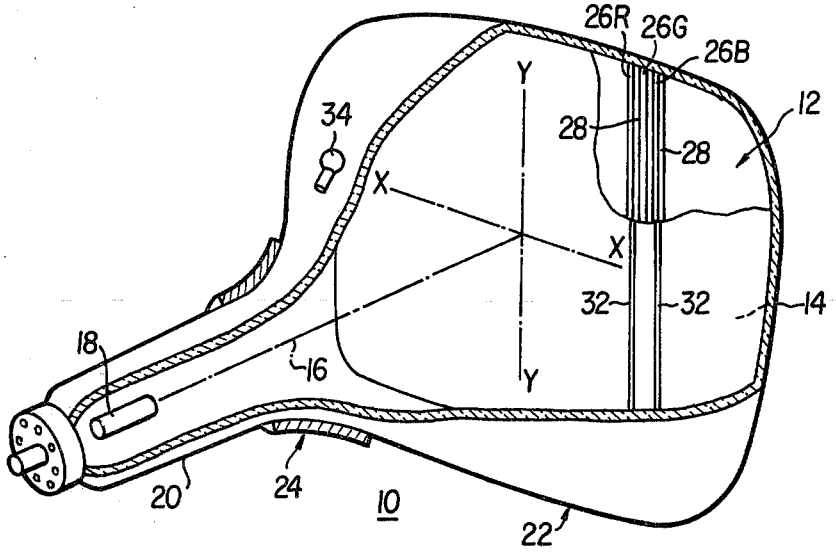
FIG. 1 is a perspective view of a preferred embodiment of the present invention.

Referring to FIG. 1, the beam-index tube apparatus 10 (hereinafter simply termed index tube apparatus) comprises a beam-index type picture tube (hereinafter simply termed index tube) 22, which includes a faceplate 14 provided with a phosphor screen 12 on the internal surface thereof and a neck portion 20 provided with an electron gun 18 to generate an electron beam 16 of an oval cross-section impinging on the phosphor screen 12, and a deflecting device 24 for deflecting the electron beam 16 horizontally and vertically.

The phosphor screen 12 comprises red, green, and blue phosphor stripes 26R, 26G, and 26B, light absorbing stripes 28 each disposed between the phosphor stripes 26R, 26G, and 26B. Indexing stripes 32 are provided, with interposition of an aluminum layer 30, on the side of the phosphor threads facing the electron gun 18 in a predetermined relation with the phosphor stripes.

Furthermore, the index tube apparatus 10 includes a photoelectric element photomultiplier 34 which converts the light (for instance, ultraviolet rays) from the indexing stripes 32 into an electric signal as an indexing signal therefrom.

Figure 2A:
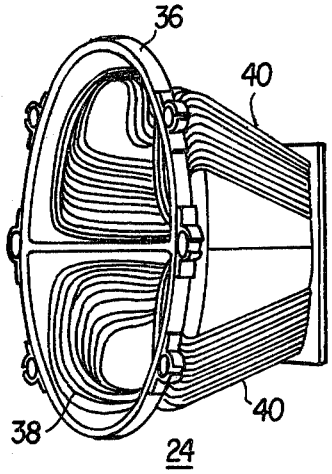
FIG. 2 A is a perspective view of a deflecting device used in a beam-index tube apparatus according to the present invention.
FIG. 2B is a plan view taken from the phosphor screen of the deflecting device shown in FIG. 2A.
Figure 2B:
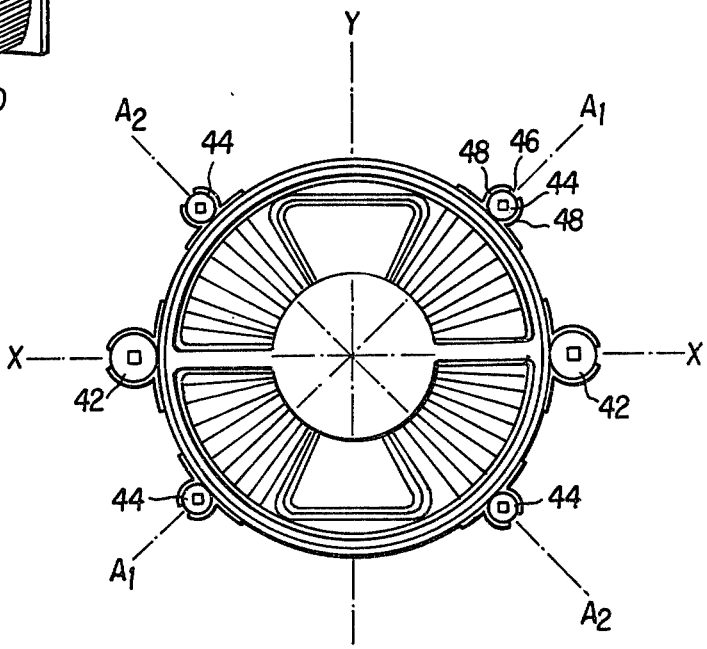

Referring to FIGS. 2A and 2B, the deflecting device 24 comprises a deflecting yoke comprising a pair of horizontal deflecting coils 38 and a pair of vertical deflecting coils 40 provided respectively inside and outside of a truncated conical yoke 36, and eight correcting elements 42 and 44 provided on the periphery of a front end of the deflecting yoke 36, facing the phosphor screen 12, positioned corresponding to the horizontal axis X—X and the diagonal axes $A_1$—$A_1$ and $A_2$—$A_2$ of the index tube 22. Each of the correcting elements 42 and 44 comprises a cylindrical permanent magnet 46 and a pair of polepieces 48. The permanent magnet is rotatably secured to the outer periphery of the yoke 36 by the polepieces 48 so that the effect of the permanent magnet 46 on the deflecting magnetic field can be thereby controlled.

Figure 3A:
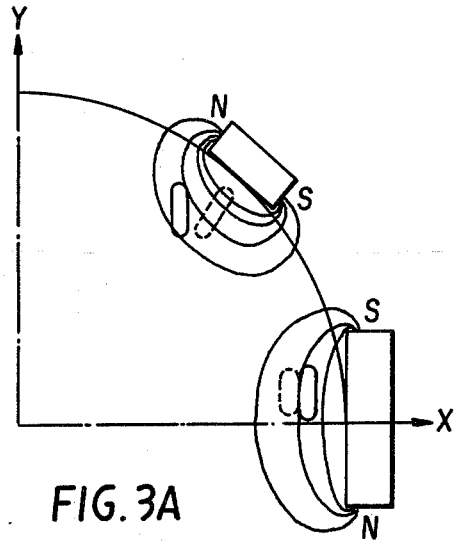
FIGS. 3A and 3B are diagram used for explaining the operation of the deflecting device according to the invention.

The operation of the deflecting device 24 will now be described with reference to FIG. 3A.

The magnetic field produced by the deflecting yoke is so established that when the electron beam is deflected along the horizontal axis, positive isotropic astigmatism is realized in the electron beam, and when the electron beam is deflected along the vertical axis, negative isotropic astigmatism is realized in the electron beam. As a result, when the electron beam is deflected along the diagonal axes, positive anisotrpic astigmatism is realized in the electron beam. In other words, the horizontal magnetic field is formed as its entirety into a pin cushion-shape, while the vertical magnetic field is formed as its entirety into a barrel-shape. As a result, the electron beam is substantially overfocused in the horizontal direction when it is deflected along the horizontal axis and the vertical axis.

The aforementioned correcting elements 42 and 44 are so arranged that when the electron beam is deflected along the horizontal axis, positive isotropic astigmatism is achieved, while when the electron beam is deflected along the diagonal axes, positive anisotropic astigmatism is achieved in the electron beam. That is, as shown is FIG. 3A, the magnetic field of the correcting elements positioned on the diagonal axes raises the electron beam inclined by the deflecting filed of the deflecting yoke, and the magnetic filed of the correcting elements positioned on the horizontal axis decreases the width of the electron beam when the beam is deflected along the horizontal axis.

Accordingly, by using the deflecting device providing with a deflecting field comprising the magnetic field of the deflecting yoke and the magnetic field of the correcting elements, the cross-sectional size of the electron beam impinging on the phosphor screen has a predetermined width when the beam is deflected along the horizontal axis, that is, the beam focuses on the phosphor screen when the beam is deflected along the horizontal axis, and the rotation of the beam is brought to substantially zero when the beam is deflected along the diagonal axes.

Figure 3B:
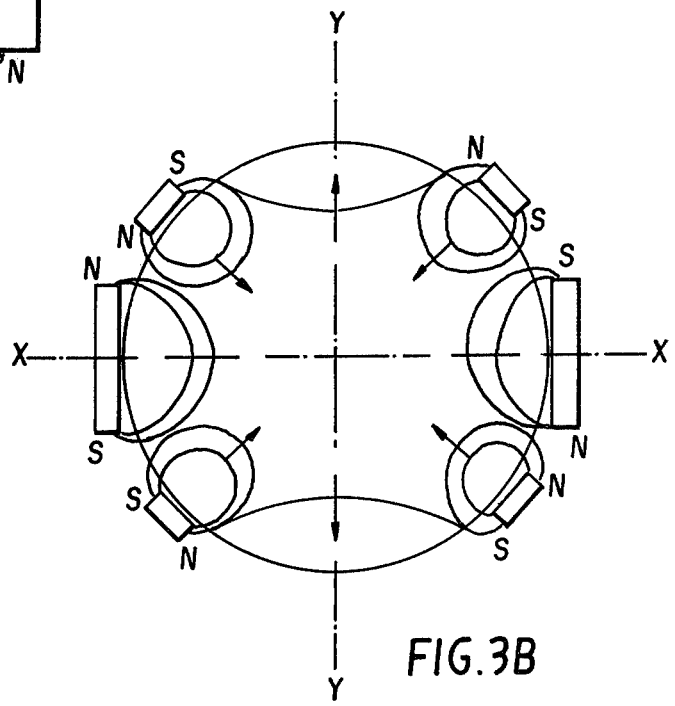
Figure 4:
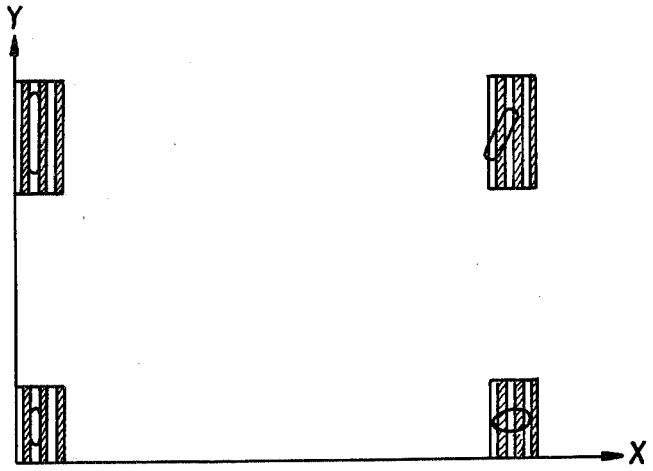
FIG. 4 is a diagram showing the state of the projected electron beam on the phosphor screen of a conventional beam-index type picture tube.

The deflecting device provides an additional effect upon the electron beam as follows. A raster formed by the deflecting yoke described above is deformed because of aberrations in the magnetic field of the deflecting yoke. However, fortunately, the correcting elements arranged as described above adjust the size and shape of the raster a to predetermined raster. As shown in FIG. 3B, the correcting elements compress at least the parts near the diagonal extremities of the raster, and expand at least the parts near the horizontal extremities of the raster.

The magnetic field created by the auxiliary deflecting elements 42 and 44 is that of an eight pole distribution. More specifically, the intensity of the magnetic field created by the auxiliary deflecting elements 42 arranged at positions corresponding to the horizontal axis is preferably made greater than that of the auxiliary deflecting elements 44 provided at positions corresponding to the diagonal axes.

By the provision of the correcting elements 42 and 44 thus creating a magnetic field of eight poles, the twisting of the electron beam at the extremities of the diagonal axes, which constitutes a difficulty of the conventional device, can be corrected easily, and by selecting the intensity of the magnetic field created by the auxiliary deflecting elements 42 arranged for the horizontal axis to be greater than the other, the dynamic convergence correcting circuit for the horizontal direction can be eliminated.

The advantageous features of the present invention are as follows.

Firstly, since correcting elements made of permanent magnets are employed, the turn-end effect of saddle-shaped coils ordinarily used for the horizontal deflecting coil and the like can be substantially eliminated, and as a result any desirable magnetic field can be realized. Secondly, the size of the beam deflecting yoke can be reduced as in the case of the monochromatic picture tube.

What is claimed is:

1. A beam-index tube apparatus comprising:

(a) a beam-index pucture tube having an electron gun generating an electron beam of an oval cross-section; and (b) a beam deflecting device comprising, a deflecting yoke provided with at least one pair of horizontal deflecting coils and at least one pair of vertical deflecting coils for deflecting said electron beam in the corresponding directions, the magnetic field created by the deflecting yoke acting upon the electron beam so as to overconverge the same when the beam is deflected along the horizontal and vertical axes; and first and second groups of correcting elements, each made of a permanent magnet, arranged in the proximity of an end of said deflecting yoke facing toward the phosphor surface of the picture tube at positions corresponding to the horizontal axis and the diagonal axes of the same tube, said correcting elements acting upon the electron beam so as to provide positive isotropic astigmatism when the electron beam is deflected along the horizontal axis, and to provide negative anisotropic astigmatism when the electron beam is positioned on the diagonal axes, thus correcting a widened and rotated electron beam.

2. A beam-index tube apparatus in claim 1 wherein the intensity of the magnetic field created by said first group of correcting elements arranged on the beam-index tube positioned corresponding to the horizontal axis is greater than the intensity of the magnetic field created by said second group of correcting elements positioned corresponding to the diagonal axes of the same tube.

3. A beam-index tube apparatus in claim 1 wherein each of said correcting elements comprises a permanent magnet and one pair of pole-pieces.

* * * * *